US008886060B2

(12) United States Patent
Kakigi

(10) Patent No.: US 8,886,060 B2
(45) Date of Patent: Nov. 11, 2014

(54) PRINT APPARATUS AND METHOD OF CONTROLLING THE SAME, AND STORAGE MEDIUM AND CARTRIDGE

(75) Inventor: Nobuyoshi Kakigi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 353 days.

(21) Appl. No.: 13/344,856

(22) Filed: Jan. 6, 2012

(65) Prior Publication Data

US 2012/0195604 A1 Aug. 2, 2012

(30) Foreign Application Priority Data

Jan. 28, 2011 (JP) ..... 2011-017116

(51) Int. Cl.
*G03G 15/00* (2006.01)
*G03G 21/00* (2006.01)
*G03G 15/01* (2006.01)

(52) U.S. Cl.
CPC ..... *G03G 15/75* (2013.01); *G03G 15/553* (2013.01); *G03G 15/55* (2013.01); *G03G 2215/0132* (2013.01); *G03G 21/0094* (2013.01); *G03G 15/0189* (2013.01)
USPC ..... 399/26

(58) Field of Classification Search
USPC ..... 399/26
See application file for complete search history.

(56) References Cited

U.S. PATENT DOCUMENTS 5,500,716 A 3/1996 Morishita et al.
5,877,692 A * 3/1999 Watanabe et al. ..... 340/679
6,597,469 B1 * 7/2003 Kuroyanagi ..... 358/1.15
7,003,233 B2 * 2/2006 Matsuda et al. ..... 399/27
7,092,653 B2 * 8/2006 Yoshizuka et al. ..... 399/81
7,106,981 B2 * 9/2006 Hashimoto et al. ..... 399/25
7,197,262 B2 * 3/2007 Itabashi ..... 399/113
7,269,377 B2 * 9/2007 Mori ..... 399/113
7,315,708 B2 * 1/2008 Burchette et al. ..... 399/109
2005/0117934 A1 * 6/2005 Murayama et al. ..... 399/111
2005/0254833 A1 * 11/2005 Yokoe ..... 399/12
2006/0025967 A1 * 2/2006 Furno et al. ..... 702/184
2006/0034627 A1 * 2/2006 Kikuchi et al. ..... 399/24

(Continued)

FOREIGN PATENT DOCUMENTS

CN 1503077 A 6/2004
CN 1752869 A 3/2006

(Continued)

OTHER PUBLICATIONS

Office Action issued in Chinese Application No. 201210020598.1 dated Apr. 30, 2014.

*Primary Examiner* — David Bolduc
(74) *Attorney, Agent, or Firm* — Fitzpatrick, Cella, Harper & Scinto

(57) ABSTRACT

In a print apparatus having a photosensitive drum used for color printing, the number of sheets on which color printing has been performed and the number of sheets on which monochrome printing has been performed are obtained. It is determined whether or not the lifetime of the photosensitive drum used for color printing has expired based on a threshold value determined based on the ratio between the number of sheets on which color printing has been performed and the number of sheets on which monochrome printing has been performed and the sum of the number of sheets on which the color printing has been performed and the number of sheets on which the monochrome printing has been performed.

9 Claims, 7 Drawing Sheets

(56) References Cited

U.S. PATENT DOCUMENTS

| | | | | |
|---|---|---|---|---|
| 2006/0045549 | A1* | 3/2006 | Ahn | 399/25 |
| 2006/0067729 | A1* | 3/2006 | Ikeda et al. | 399/101 |
| 2006/0269323 | A1* | 11/2006 | Kabata et al. | 399/159 |
| 2007/0058997 | A1* | 3/2007 | Sakita et al. | 399/27 |
| 2007/0086808 | A1* | 4/2007 | Fujisawa et al. | 399/178 |
| 2007/0122167 | A1 | 5/2007 | Sugiyama et al. | |
| 2007/0140710 | A1* | 6/2007 | Okano | 399/13 |
| 2008/0050130 | A1* | 2/2008 | Kishi | 399/24 |
| 2008/0226328 | A1* | 9/2008 | Sakabe | 399/82 |
| 2009/0022513 | A1* | 1/2009 | Burchette et al. | 399/109 |
| 2009/0210278 | A1* | 8/2009 | Kamisuwa et al. | 705/8 |
| 2009/0269086 | A1* | 10/2009 | Mikuni | 399/12 |
| 2011/0216358 | A1* | 9/2011 | Katou et al. | 358/1.15 |
| 2011/0293295 | A1* | 12/2011 | Shinohara | 399/24 |
| 2012/0045224 | A1* | 2/2012 | Amann et al. | 399/24 |

FOREIGN PATENT DOCUMENTS

| | | | |
|---|---|---|---|
| JP | 07-325517 | A | 12/1995 |
| JP | 08-129325 | A | 5/1996 |
| JP | 2000-029266 | A | 1/2000 |

* cited by examiner

| COLOR RATIO | COEFFICIENT | |
|---|---|---|
| 100~75 | 1 | 405 |
| 74~50 | 1.3 | 406 |
| 49~25 | 1.7 | 407 |
| 24~0 | 2 | 408 |

PRINT APPARATUS AND METHOD OF CONTROLLING THE SAME, AND STORAGE MEDIUM AND CARTRIDGE

BACKGROUND OF THE INVENTION

1. Field of the Invention

The present invention relates to a print apparatus, a method of controlling the print apparatus, a storage medium and a cartridge.

2. Description of the Related Art

In an electrophotographic print apparatus, such as a color LBP (Laser-Beam Printer), 4 series drum type electro-photographic engines are now normally used. In such print apparatuses, upon color printing all of the photosensitive drums associated with the yellow, magenta, cyan and black cartridges, in contact with a sheet or a sheet conveyance belt, are rotated to develop a color image. On the other hand, upon monochrome printing, only the photosensitive drum associated with the black cartridge, in contact with a sheet or the sheet conveyance belt, is rotated to develop a monochrome image.

However, an electro-photographic engine using common drum control upon color and monochrome printing is known. Upon monochrome printing, printing is performed without moving the photosensitive drums for color printing away from the belt. According to this technique, the number of driving parts required to move the photosensitive drums away from the belt can be reduced and the structure can be simplified, thereby cost a reduction can be realized.

Further, in a print job based on mixed data of color data and monochrome data much time is required for switching between color print mode and monochrome print mode when the photosensitive drums are moved away from the belt, as it takes time to move the drums. However, in the above structure where the photosensitive drums for color printing are not moved away from the belt even upon monochrome printing, the reduction of printing speed due to the print mode switching processing can be suppressed.

However, in the above case where the photosensitive drums for color printing are not moved away from the belt even upon monochrome printing wear and tear can be caused to the parts related to these photosensitive drums, as the photosensitive drums for the colors not used in the printing, i.e., yellow, magenta and cyan colors, are also rotated.

As described above, in the 4 series drum type of electro-photographic engine, the cost, the speed and the lifetime are closely correlated. It is important to determine the apparatus configuration while maintaining the balance among these factors. For example, it is known to calculate the wear and tear when all the pages of an original are to be printed in color mode and when monochrome pages are printed in monochrome mode; and to perform printing in which ever one of the color mode or the monochrome mode which produces the lower degree of wear and tear (see Japanese Patent Laid-Open No. 2000-29266 (D1)). According to this technique, it is possible to suppress wear and tear of the drum or the like by controlling the switching between the color mode and the monochrome mode.

Further, the wear and tear of the drum which occurs upon printing also occurs in print post processing. Accordingly, it is known to accurately determine the lifetime of a photosensitive drum in consideration of the wear and tear during print post processing (see Japanese Patent Laid-Open No. 7-325517 (D2)).

When a printing apparatus which does not move the photosensitive drums away during printing is used, the photosensitive drums for yellow, magenta and cyan colors are more seriously worn in color printing than they are in monochrome printing. However, in actual fact, the printing apparatus does not make distinction between wear and tear on photosensitive drums during color printing and monochrome printing. There is no difference in wear and tear on rollers and gears between processing to form an image on the photosensitive drum and processing which does not result in an image being formed on the photosensitive drum, since rotating the rollers and the gears for rotation of the photosensitive drum are rotated upon printing in each case. However, the occurrence/non-occurrence of charging and the degree of abrasion of the drum surface differ between a case where an image is formed on the photosensitive drum and a case where no image is formed on the photosensitive drum. Accordingly, the wear and tear of the photosensitive drum when image formation is performed on the photosensitive drum and that when image formation is not performed on the photosensitive drum are different from each other. For example, when the print apparatus is used mainly for the purpose of facsimile printing, the frequency of monochrome printing is high and that of color printing is low. Conventionally, there is no distinction between the wear and tear of the photosensitive drum during color printing and during monochrome printing. In the above case where monochrome printing is mainly performed, even though the lifetime of the photosensitive drum for color printing is not actually expired, it is determined that the lifetime of the photosensitive drums for color printing or cartridges having the photosensitive drums has expired when the lifetime of the photosensitive drum for monochrome printing has been expired.

The above-described conventional technique D1 proposes a method for suppression of the wear and tear on consumable parts. To suppress wear and tear on the consumable part, a control method is proposed in which a choice is made regarding moving the drum away. However, this control method cannot solve the problem in the structure where the drums are not moved away.

Further, the above-described conventional technique D2 discloses the accurate calculation of wear and tear on the drum in consideration of wear and tear in post processing of printing in addition to wear and tear on the drum during printing. However, this method of calculating the wear and tear on a drum does not take into consideration the difference in wear and tear of the drum for color printing and for monochrome printing.

SUMMARY OF THE INVENTION

An aspect of the present invention is to eliminate the above-mentioned problems in the conventional technology.

Another aspect of the present invention is to provide a technique of more accurately determining wear and tear of a photosensitive drum for color printing and accurately notifying timing of exchange of a toner cartridge having the photosensitive drum.

The present invention in its first aspect provides a print apparatus having a photosensitive drum used for color printing, comprising: an acquisition unit configured to acquire the number of sheets on which color printing has been performed and the number of sheets on which monochrome printing has been performed; and a determination unit configured to determine whether or not a lifetime of a photosensitive drum used for the color printing has expired, based on a threshold value and the sum of the number of sheets on which the color printing has been performed and the number of sheets on which the monochrome printing has been performed, the threshold value being determined based on a ratio between the number of sheets on which color printing has been performed and the number of sheets on which monochrome printing has been performed acquired by the acquisition unit.

The present invention in its second aspect provides a control method for a print apparatus having a photosensitive drum used for color printing, comprising: an acquisition step of acquiring the number of sheets on which color printing has been performed and the number of sheets on which monochrome printing has been performed; and a determination step of determining whether or not a lifetime of a photosensitive drum used for the color printing has expired, based on a threshold value determined based on a ratio of the number of sheets on which color printing has been performed to the sum of the number of sheets on which the color printing has been performed and the number of sheets on which the monochrome printing has been performed, acquired in the acquisition step.

Further features and aspects of the present invention will become apparent from the following description of embodiments with reference to the attached drawings.

BRIEF DESCRIPTION OF THE DRAWINGS

The accompanying drawings illustrate embodiments of the invention and, together with the description, serve to explain the principles of the invention.

DESCRIPTION OF THE EMBODIMENTS

Hereinbelow, embodiments of the present invention are described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Each of the embodiments of the present invention described below can be implemented solely or as a combination of a plurality of the embodiments or features thereof where necessary or where the combination of elements or features from individual embodiments in a single embodiment is beneficial.

Figure 1:
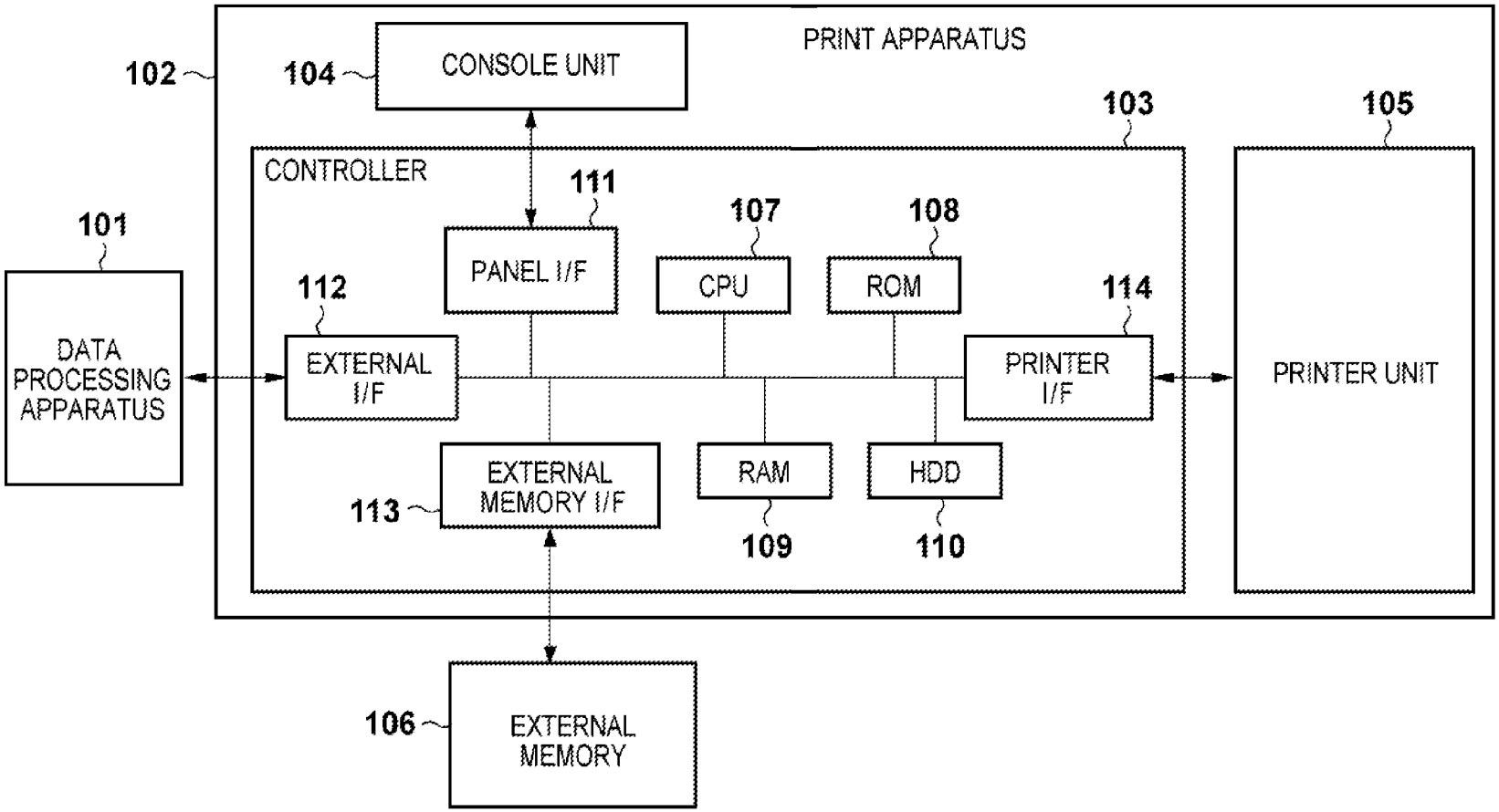
FIG. 1 is a block diagram schematically showing the configuration of a print system according to embodiments of the present invention.

FIG. 1 is a block diagram schematically showing the configuration of a print system according to embodiments of the present invention. In the print system, a print apparatus 102 performs printing based on print data (image information) supplied from a data processing apparatus 101.

The data processing apparatus 101 which is e.g. a computer, functions as an image information supply source or a controller for the print apparatus 102. In the present embodiment, as the print apparatus 102, a laser beam printer is used. Further, the print apparatus 102 applied in the present embodiment is not limited to the laser beam printer. As the print apparatus 102, a copier or a facsimile machine having an electrophotographic printer engine, or an MFP (multi function peripheral) having these plural functions may be used.

Next, the configuration of the print apparatus 102 will be described. A controller 103 generates raster data by page based on image information (e.g. ESC code or page description language) supplied from the data processing apparatus 101, and transmits the raster data to a printer unit 105. The printer unit 105 forms a latent image on a photosensitive drum based on the raster data supplied from the controller 103, transfers the latent image on a print medium (sheet) and fixes the image to the print medium (by electrophotography), thereby forms an image. The controller 103 has a CPU 107, a ROM 108, a RAM 109, an HDD 110, a panel I/F (interface) 111, an external I/F 112, an external memory I/F 113, and a printer I/F 114. The CPU 107 controls the print apparatus 102. The ROM 108 holds various programs read by the CPU 107. The RAM 109 is used as a work area for the CPU 107. The HDD 110 holds programs and print data. The panel I/F 111 controls data transmission/reception between the controller 103 and a console unit 104. The external I/F 112 controls transmission/reception between the controller 103 and the data processing apparatus 101. The external memory I/F 113 controls data transmission/reception between the controller 103 and an external memory 106. The printer I/F 114 controls data transmission/reception between the controller 103 and the printer unit 105.

The console unit 104 is used as a user interface. A user operates various buttons, switches and the like of the console unit 104, to instruct a desired operation. Further, the console unit 104 has a display unit to display processing content in the print apparatus 102 and alert for the user. In a power saving mode, no display is produced on the display unit. The external memory I/F 113 is used for connection with an external memory such as a USB memory or an SD card. The external memory I/F 113 performs data transmission/reception between the external memory 106 and the controller 103.

Figure 2:
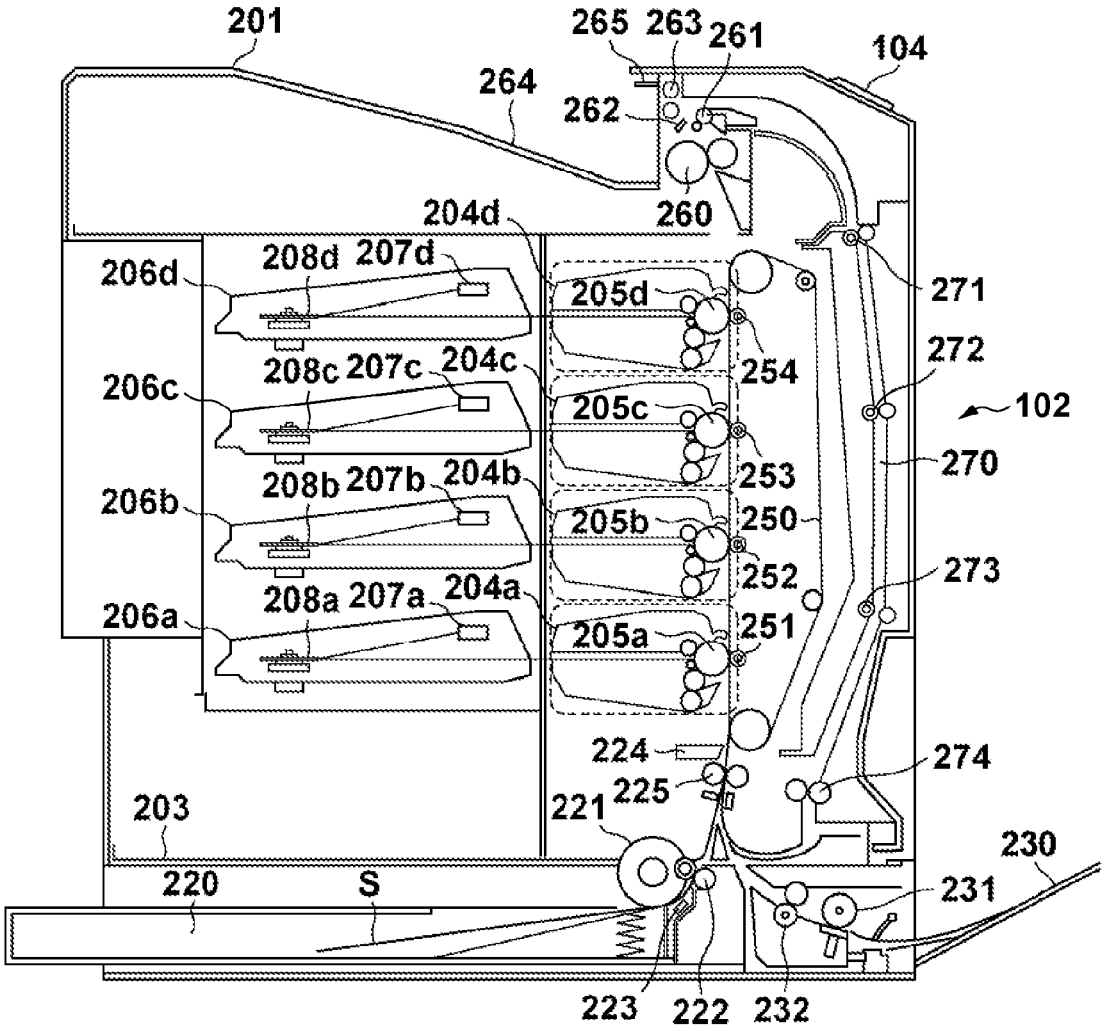
FIG. 2 depicts a cross-sectional view schematically showing the structure of a print apparatus according to the embodiments.

FIG. 2 depicts a cross-sectional view showing the structure of the print apparatus (image forming apparatus) 102 according to the embodiments.

In FIG. 2, reference numeral 201 denotes a case of the print apparatus 102. The console unit 104 is provided with switches for the user to input various instructions, LED and LCD display units to display messages, printer setting contents and the like. A board accommodation unit 203 accommodates boards (print circuit boards) as electronic circuit parts of the controller 103, the printer unit 105 and the like. A paper cassette 220, capable of holding plural sheets S (print sheets or print media), has a mechanism to electrically detect the size of contained sheets in accordance with the position of a partition plate (unshown). A cassette clutch 221 has a cam to pick up the top one of the sheets S contained in the paper cassette 220 and convey the picked sheet S to a paper feed roller 222 with a driving force transmitted from a driving unit (unshown). The cam is intermittently rotated upon each paper feed, to supply one sheet S by 1 rotation. A paper detection sensor 223 detects the amount of the sheets S contained in the paper cassette 220. The paper feed roller 222 is used for conveyance of an end of the sheet S to the position of a registration shutter 224. The registration shutter 224 can stop paper feed by pressing the sheet S.

Numeral 230 denotes a manual feed tray. A manual feed clutch 231 is used for conveyance of the end of the sheet S supplied from the manual feed tray 230 to a manual feed roller 232. The manual feed roller 232 is used for conveyance of the end of the sheet S to the position of the registration shutter 224. In this manner, the sheet S used in printing is supplied to the paper cassette 220 or the manual feed tray 230 as a selected feed unit.

The printer unit 105 performs communication with the controller 103 in accordance with a predetermined communication protocol, and selects the paper cassette 220 or the manual feed tray 230 as a paper feed unit based on an instruction from the controller 103. Then, in correspondence with a print start instruction, the printer unit 105 conveys the sheet S from the corresponding paper feed unit to the position of the registration shutter 224. Note that the printer unit 105 includes the paper feed unit, mechanisms related to electrophotographic process including formation, transfer and fixing of a latent image, a paper discharge unit and their controllers.

Numerals 204*a* to 204*d* denote image forming units (process cartridges) having photosensitive drums 205*a* to 205*d* and toner holders to form a toner image on the sheet S by the electrophotographic process. The image forming units 204*a* to 204*d* are respectively attached to the apparatus main body, and form yellow, magenta, cyan and black images. Numerals 206*a* to 206*d* denote laser scanners to respectively form an electrostatic latent image corresponding to color image data by a laser beam on the photosensitive drum of the corresponding image forming unit. A sheet conveyance belt 250 for conveyance of the sheet S is put respectively around the image forming units 204*a* to 204*d*, with plural rotating rollers 251 to 254, in a flat shape, in a sheet conveyance direction (upward direction from the lower side of FIG. 2). In the sheet conveyance belt 250, the sheet S is electrostatically attracted to the belt in the top upstream position with an adsorption roller 225. Further, four photosensitive drums 205*a* to 205*d* are linearly provided oppositely to a conveyance surface of the sheet conveyance belt 250. The image forming units 204*a* to 204*d* respectively have a charger and a developer, sequentially surrounding the periphery of the photosensitive drum.

In the laser scanner units 206*a* to 206*d*, numerals 207*a* to 207*d* denote laser units. These laser units respectively drive an internal semiconductor laser to emit a laser beam in correspondence with an image signal (/VIDEO signal) supplied from the controller 103. The laser beams emitted from the laser units 207*a* to 207*d* are reflected with corresponding rotating polygonal mirrors 208*a* to 208*d*. The reflected laser beams scan the surfaces of the corresponding photosensitive drums 205*a* to 205*d*, to form latent images corresponding to the respective corresponding color image signals on the surfaces of the photosensitive drums.

A fixing unit 260 heat-fixes the toner images, formed on the sheet S with the image forming units 204*a* to 204*d*, to the sheet S. A conveyance roller 261 conveys the sheet S and discharges the sheet S. A discharged paper sensor 262 detects a sheet discharge status of the sheet S. A discharge and switching roller 263 conveys the sheet S in a sheet discharge direction. When the conveyance instruction of the sheet S is "sheet discharge", the discharge and switching roller 263 discharges the sheet onto a discharge tray 264. On the other hand, when the conveyance instruction is "conveyance for double-sided printing", the discharge and switching roller 263 reverses its rotational direction immediately after passing of a rear end of the sheet S through the discharged paper sensor 262, to switch-back convey the sheet S to a conveyance path 270 for double-sided printing. A stacking sheet amount detection sensor 265 detects a stacked amount of the sheets on the sheet discharge tray 264. The sheet S conveyed with the discharge and switching roller 263 to the conveyance path 270 for double-sided printing is again conveyed with conveyance rollers 271 to 274 to the registration shutter 224, and waits for an instruction of conveyance to the image forming units 204*a* to 204*d*.

Note that it is possible to provide the print apparatus 102 with further optional units such as an optional cassette and an envelope feeder.

Figure 3A:
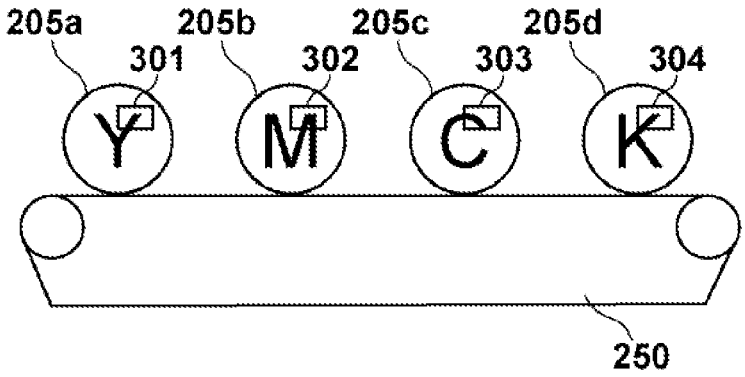
FIGS. 3A to 3C are schematic diagrams showing relation between photosensitive drums and a sheet conveyance belt.
Figure 3B:
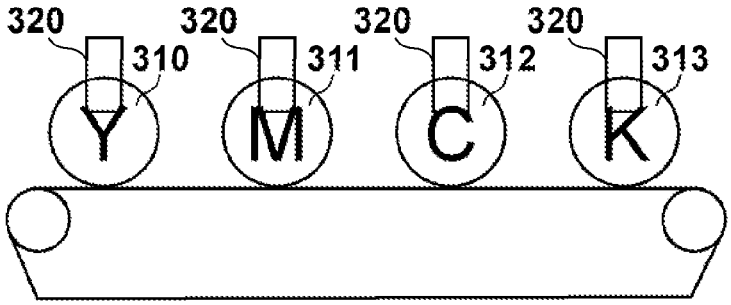
Figure 3C:
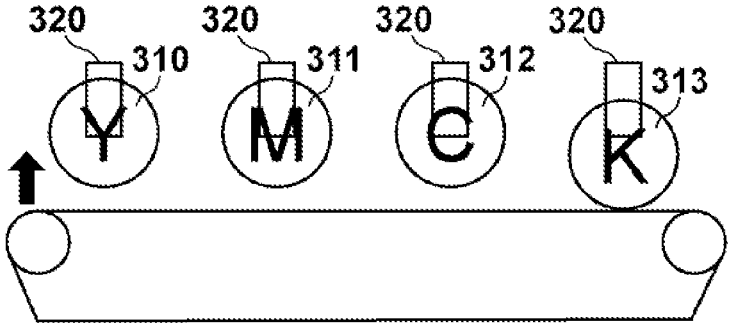

FIGS. 3A to 3C are schematic diagrams showing relation between the photosensitive drums and the sheet conveyance belt 250. These figures correspond to a structure where the photosensitive drums and the sheet conveyance belt 250 shown in FIG. 2 are rotated clockwise at 90°.

FIG. 3A schematically illustrates a 4 series drums type of electrophotographic engine where the photosensitive drums 205*a* to 205*d* and the belt 250 are not away from each other. Since the four types of toner cartridges, Y (yellow), M (magenta), C (cyan) and K (black) cartridges (hereinbelow, simply referred to as "cartridges") have no independent separation mechanism, the respective photosensitive drums of the respective color cartridges are not moved away from the belt 250. Note that these cartridges are so-called process cartridges each having a toner container containing toner and the photosensitive drum. The sheet S is passed between the photosensitive drums of the respective cartridges and the sheet conveyance belt 250, thereby a toner image is formed on the surface of the sheet, and the toner image is fixed to the sheet with the fixing unit 260 (FIG. 2). The respective cartridges have corresponding small-sized nonvolatile memories 301 to 304 to respectively hold the number of print pages using the cartridge, the lifetime status and the like, for each of the Y (yellow), M (magenta), C (cyan) and K (black) colors. The user can open a front door of the print apparatus 102 to independently exchange the four types of Y (yellow), M (magenta), C (cyan) and K (black) cartridges.

FIGS. 3B and 3C illustrate another 4 series drums type of electrophotographic engine different from the print apparatus (FIG. 3A) according to the embodiment. The photosensitive drums and the belt are moved away from each other. A photosensitive drum 310 of the cartridge Y, a photosensitive drum 311 of the cartridge M, a photosensitive drum 312 of the cartridge C, and a photosensitive drum 313 of the cartridge K can be independently moved away from the belt. Numeral 320 denotes a plate to independently move the photosensitive drums of the respective cartridges into contact with or away from the belt. Upon color printing, a print operation is performed in the status shown in FIG. 3B. Upon monochrome printing, a print operation is performed while the Y, M and C photosensitive drums are away from the belt 250, as shown in FIG. 3C.

Note that the embodiments are described about the structure shown in FIG. 3A. However, even in a structure where the photosensitive drum can be moved away from the belt 250, the present invention is advantageous when the photosensitive drums of the color cartridges are not moved away from the belt 250 upon monochrome printing. Note that in FIGS. 3B and 3C, the user can open the front door of the print apparatus 102 to independently exchange the four types of Y (yellow), M (magenta), C (cyan) and K (black) cartridges.

<First Embodiment>

Figures 4A, 4B:
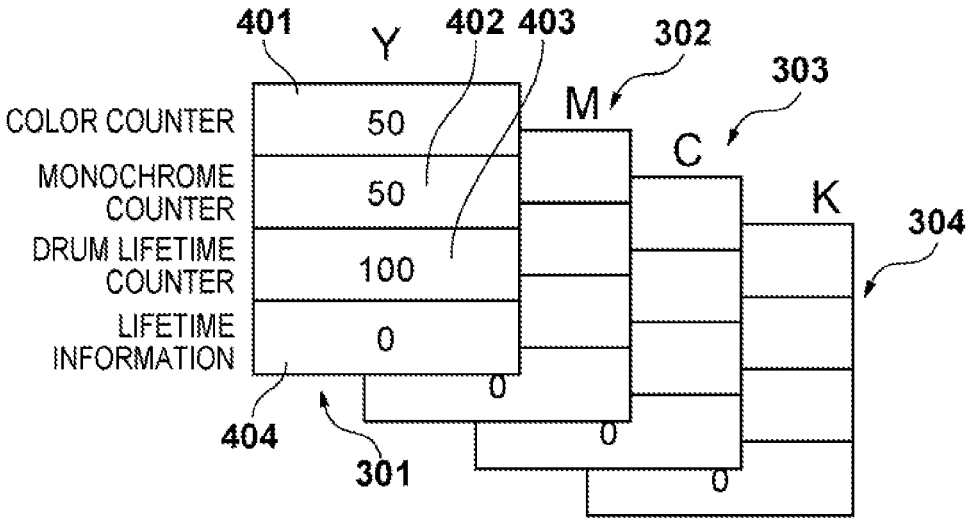
FIG. 4A depicts a view illustrating an example of information stored in a memory of a cartridge according to a first embodiment of the present invention.
FIG. 4B depicts a view illustrating an example of a conversion table.

FIG. 4A illustrates information stored in the memories 301 to 304 of the respective cartridges in FIG. 3A. FIG. 4B is an example of a conversion table stored in the ROM 108 or the HDD 110. As described in FIG. 3A, the respective cartridges have the small-sized memories 301 to 304.

FIG. 4A depicts a view illustrating an example of information stored in the respective memories 301 to 304 according to a first embodiment of the present invention. The memory values of these memories 301 to 304 are read/written from/into the memories by the CPU 107 of the controller 103.

Upon color printing, in a color counter 401, the count value is incremented (+1) by printing for one sheet, and the number of color-printed sheets is stored. Upon monochrome printing, in a monochrome counter 402, the counter value is incremented (+1) by printing for one sheet, and the number of monochrome-printed sheets is stored. Upon color printing and monochrome printing, in a drum lifetime counter 403, a value indicating wear and tear (use information) of the drum by print processing is incremented by printing for one sheet. That is, the value of the drum lifetime counter 403 is the sum of the value of the color counter 401 and the value of the monochrome counter 402. As lifetime information 404, bit information (described later with reference to FIG. 5) indicating whether or not the lifetime of the drum of the cartridge has expired (OUT) is held. Further, a status where the lifetime has almost expired (Low) (described later with reference to FIG. 5) can also be held. In this manner, the lifetime stages are managed as plural levels. These items of information are stored by the CPU 107 into the memories 301 to 304 of the respective Y (yellow), M (magenta), C (cyan) and K (black) cartridges. That is, upon color printing, the CPU 107 increments the value of the color counter 401 in the memories 301 to 304 of the respective cartridges and the value of the drum lifetime counter 403. Further, upon monochrome printing, the CPU 107 increments the value of the monochrome counter 402 in the memories 301 to 304 of the respective cartridges and the value of the drum lifetime counter 403. Note that the increment may be performed upon issuance of a paper feed signal from the CPU 107 to the printer unit 105. Further, it may be arranged such that when the above-described discharged paper sensor 262 of the printer unit 105 detects that a sheet has been discharged onto the sheet discharge tray 264, the CPU 107 performs the incrementation.

Next, FIG. 4B shows an example of a conversion table holding a ratio between color printing and monochrome printing (color ratio) and a coefficient for calculation of drum lifetime linked to each other.

Numeral 405 denotes a coefficient value when the color ratio is 75 to 100%, numeral 406 denotes a coefficient value when the color ratio is 50 to 74%, numeral 407 denotes a coefficient value when the color ratio is 25 to 49%, and numeral 408 denotes a coefficient when the color ratio is 0 to 24%. When the color ratio is low, as the photosensitive drums of the Y, M and C cartridges rotate without transferring at high frequency, the wear and tear is low. Accordingly, the coefficient multiplied in calculation of notarization lifetime value is increased, and the drum lifetime is prolonged, and an image is printed on a larger number of sheets.

On the other hand, when the color ratio is high, the amount of idle rotation of the Y, M and C photosensitive drums is smaller, and the drum lifetime almost corresponds with the notarization lifetime. Note that the "notarization lifetime" means lifetime set by photosensitive drum in the manufacture stage. In the example of the memory 301 in FIG. 4A, the color ratio is calculated as 50% from 50/(50+50). The coefficient value in this case is "1.3" from FIG. 4B.

FIG. 4B shows a view illustrating an example of a 4-level table. The number of levels may be increased by setting finer stages, otherwise, the coefficient value may be changed by color.

Figure 5:
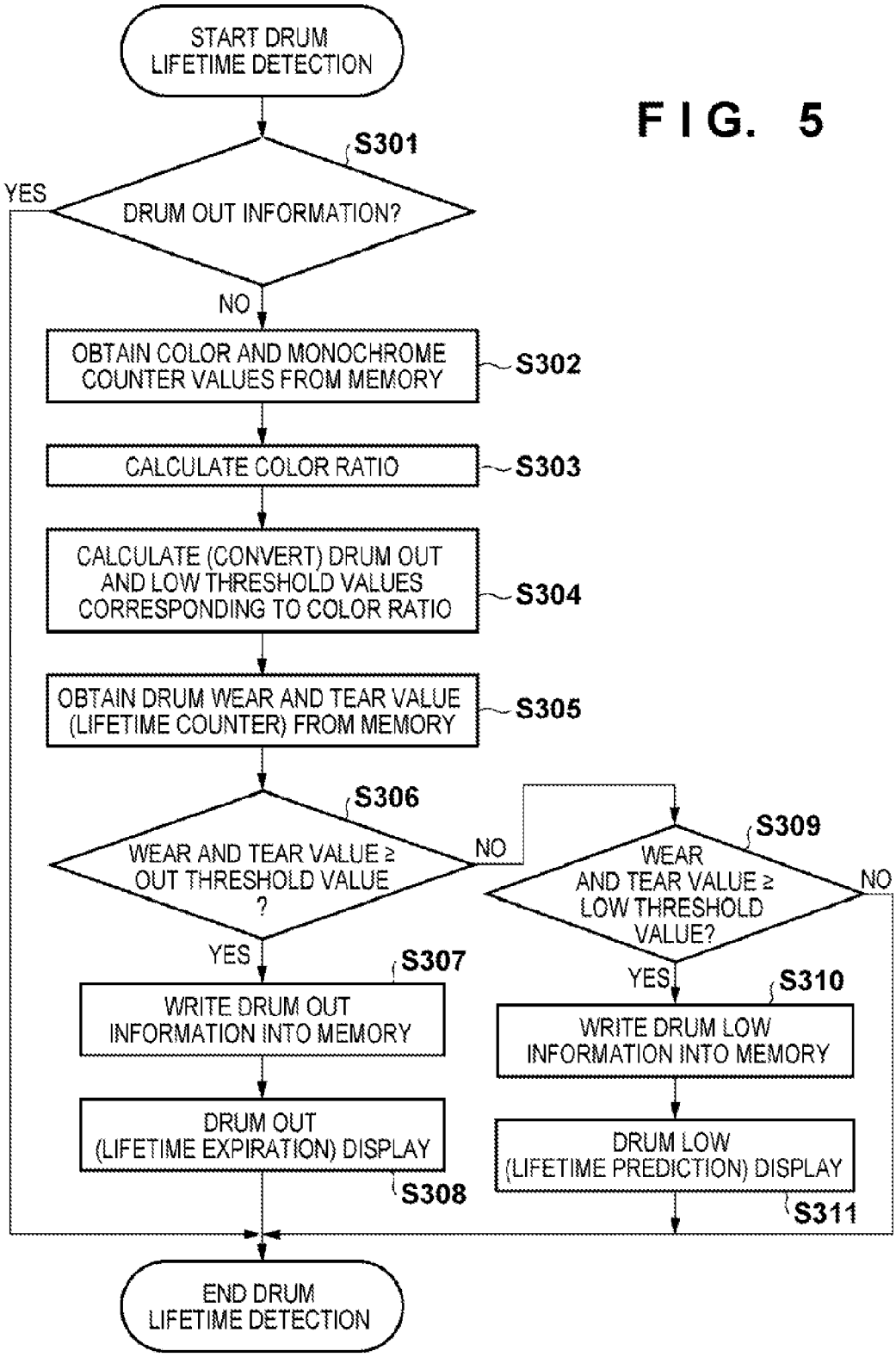
FIG. 5 is a flowchart for describing processing of determining lifetime of the photosensitive drum by the print apparatus according to the first embodiment.

FIG. 5 is a flowchart for describing processing of determining the lifetime of a photosensitive drum of a cartridge for color printing by the print apparatus according to the first embodiment. In the flowchart of FIG. 5, the respective steps are realized by reading and executing the program stored in the ROM 108 by the CPU 107.

The CPU 107 prepares an image to be print-outputted on one sheet in the HDD 110. When the CPU 107 transmits an instruction to feed one sheet to the printer unit 105, the processing shown in the flowchart of FIG. 5 starts. The image is transmitted, together with print setting information, as a job, from the data processing apparatus 101. Note that it may be arranged such that the processing is executed by the CPU 107 at predetermined timing, e.g., upon cartridge exchange, upon start-up of the print apparatus 102, elapse of predetermined time, or upon printing for a predetermined number of sheets. Note that as the processing shown in the flowchart of FIG. 5 is performed with respect to the yellow cartridge, the magenta cartridge and the cyan cartridge, the processing is repeated thrice by the CPU 107.

First, the processing performed for the yellow cartridge will be described.

In step S301, the CPU 107 determines whether or not bit information indicating a "drum OUT (=lifetime expired)" status is stored in the lifetime information 404 of the memory 301 of the yellow cartridge. When it is determined that the bit information indicating the drum OUT status is stored, the CPU 107 determines that the lifetime of the cartridge has expired. Then the lifetime detection ends.

On the other hand, when it is determined in step S301 that the bit information indicating the drum OUT status is not stored, the process proceeds to step S302. The CPU 107 obtains the respective count values of the color counter 401 and the monochrome counter 402 from the memory 301. Then, in step S303, the CPU 107 calculates the ratio between color printing and monochrome printing (color ratio). Next, in step S304, the CPU 107 obtains a coefficient corresponding to the obtained ratio from the table in FIG. 4B based on the color ratio obtained in step S303. Then the CPU 107 multiplies the notarization lifetime by the coefficient, to calculate a lifetime threshold value (OUT threshold value) for determination of photosensitive drum lifetime corresponding to the color ratio. Further, the CPU 107 subtracts a predetermined value from the lifetime threshold value (OUT threshold value), to calculate a prediction threshold value (Low threshold value) for prediction of photosensitive drum lifetime. Note that the lifetime threshold value (OUT threshold value) is used for determination as to whether or not the lifetime of the photosensitive drum has expired. Further, the prediction threshold value (Low threshold value) is used for determination as to whether or not the lifetime status of the photosensitive drum is close to expiration. For example, the lifetime threshold value is obtained by (lifetime threshold value)=(coefficient value)×(notarization lifetime value).

Further, the prediction threshold value is obtained by (prediction threshold value)=(lifetime threshold value)−(predetermined value).

The CPU 107 stores the calculated value into the RAM 109 or the HDD 110 in step S304.

In this manner, in step S304, the CPU 107 calculates lifetime threshold values at plural levels. Next, the process proceeds to step S305, in which the CPU 107 obtains the count value of the drum lifetime counter 403 indicating the current wear and tear status of the drum (the sum of the count values of the color counter 401 and the monochrome counter 402) (acquisition of wear and tear value). Next, the process proceeds to step S306, in which the count value of the drum lifetime counter 403 is compared with the lifetime threshold value obtained in step S304.

When (count value of drum lifetime counter)≥(lifetime threshold value) holds, as the wear and tear value of the photosensitive drum of the cartridge exceeds the OUT threshold value, the process proceeds to step S307. In step S307, the CPU 107 writes bit information indicating the drum OUT status into the lifetime information 404 of the memory 301 of the yellow cartridge. Then the process proceeds to step S308, in which a "drum OUT" display (lifetime expiration display) indicating that the lifetime of the yellow cartridge has expired is produced on the console unit 104.

On the other hand, in step S306, when (count value of drum lifetime counter)<(lifetime threshold value) holds, as the wear and tear value of the photosensitive drum 205*a* of the yellow cartridge does not exceed the threshold value, the process proceeds to step S309. In step S309, the CPU 107 determines whether or not the wear and tear value of the photosensitive drum exceeds the Low threshold value. When (count value of drum lifetime counter)≥(prediction threshold value) holds, as the wear and tear value of the yellow photosensitive drum 205*a* exceeds the Low threshold value, the process proceeds to step S310. In step S310, the CPU 107 writes bit information indicating the drum Low status in the lifetime information 404 of the memory 301 of the yellow cartridge. Then in step S311, the CPU 107 changes the display form in correspondence with the level of the lifetime and produces a display. That is, the CPU 107 displays the drum Low display (lifetime prediction display) indicating that the lifetime of the yellow cartridge will soon expire on the console unit 104. Note that the process ends when it is determined in step S309 that the wear and tear value of the photosensitive drum does not exceed the Low threshold value.

The CPU 107 also performs the processing shown in FIG. 5 for the magenta and cyan cartridges.

Note that in the processing with respect to the black cartridge, the lifetime threshold value, when (lifetime threshold value)=(notarization lifetime value) holds, and the prediction threshold value, when (prediction threshold value)=(lifetime threshold value)−(predetermined value) holds, are used.

The CPU 107 records the number of sheets in color printing in the color counter 401 of the memory 304, and the number of sheets in monochrome printing in the monochrome counter 402. Then the CPU 107 records the value of the color counter 401 and the value of the monochrome counter 402 in the drum lifetime counter 403. Thereafter, when (value of the drum lifetime counter 403) exceeds (prediction threshold value), the CPU 107 displays the drum Low display (lifetime prediction display) indicating that the lifetime of the photosensitive drum 205*d* of the black cartridge will soon expire on the console unit 104. Then, when (value of drum lifetime counter 403) exceeds (lifetime threshold value), the CPU 107 displays the drum OUT display (lifetime expiration display) indicating that the lifetime of the photosensitive drum 205*d* of the black cartridge has expired on the console unit 104.

Note that the CPU 107 continues the printing when it is determined that (count value of the drum lifetime counter)< (lifetime threshold value) holds at any of the cartridge. Then the CPU 107 may stop the printing when (count value of the drum lifetime counter)≥(lifetime threshold value) holds in all the cartridges. Accordingly, it is possible to assure the quality of an image to be print-outputted while effectively using the cartridge. Further, it may be arranged such that at timing of determination that (count value of drum lifetime counter)≥ (lifetime threshold value) holds at all the cartridges, the CPU 107 performs control not to feed the next sheet, otherwise, stops the printing at the end of current print copy or the end of one current job. Further, it may be arranged such that when the CPU stops printing at the end of one print copy or the end of one job, the CPU 107 determines whether or not the remaining number of sheets of the copy or job is equal to or greater than a predetermined value. When the CPU 107 determines that the remaining number of sheets of the copies of job is equal to or greater than the predetermined value, the CPU 107 stops the printing, while when the CPU 107 determines that the remaining number of sheets is less than the predetermined value, continues the printing. When the number of sheets for one copy or one job is large, this arrangement prevents printing of an image on a large number of sheets even though the lifetime of the photosensitive drum has expired.

As described above, according to the first embodiment, even in a print apparatus where all the photosensitive drums are rotated upon color printing and upon monochrome printing such as a laser beam printer where the photosensitive drums are not moved away from the belt (transfer member), the lifetimes of the photosensitive drums for the color printing and the monochrome printing can be accurately determined. Further, the status that the time of exchange of the cartridge containing the photosensitive drum has come, or the time of cartridge exchange will soon come can be more accurately notified.

<Second Embodiment>

In the above-described first embodiment, the color ratio is calculated, and the notarization lifetime is multiplied by a coefficient value corresponding to the color ratio, to calculate the lifetime of the photosensitive drum corresponding to the color ratio. In the second embodiment, a coefficient value upon actual printing with the photosensitive drum and a coefficient value upon idle rotation of the photosensitive drum are defined respectively, and the lifetime of the photosensitive drum is calculated from (actual print counter)×(coefficient value upon printing)+(idle rotation counter)×(idle rotation coefficient value).

Note that the configuration of the print system and that of the print apparatus according to the second embodiment are the same as those of the print system and the print apparatus in the above-described first embodiment (FIGS. 1 and 2), accordingly, the explanations thereof will be omitted.

Figure 6A:
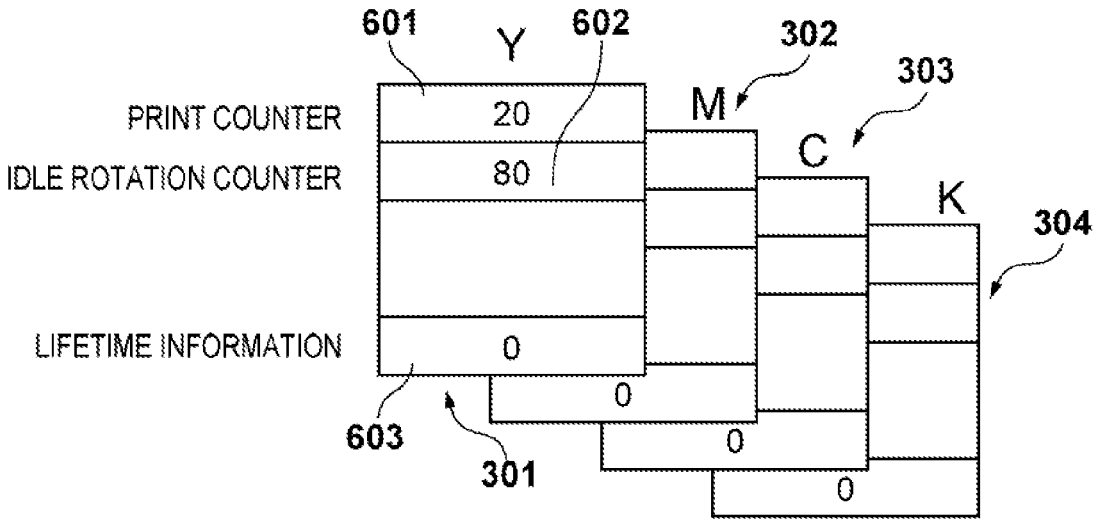
FIG. 6A depicts a view illustrating an example of information stored in the memory of the cartridge according to a second embodiment of the present invention.
Figure 6B:
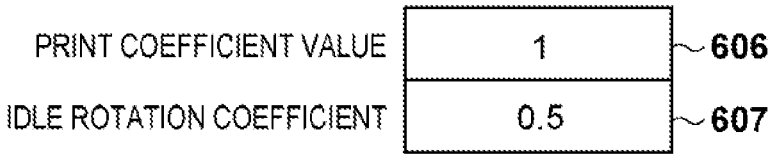
FIG. 6B depicts a view illustrating an example of the conversion table.

FIG. 6A depicts a view illustrating an example of information stored in the memories 301 to 304 of the respective cartridges in FIG. 3A. FIG. 6B shows an example of the conversion table stored in the ROM 108 or the HDD 110.

As described above, the cartridges corresponding to the respective colors have one memory (301 to 304). FIG. 6A in the second embodiment shows an example of information stored in the respective memories. When the photosensitive drum is actually used in printing, the count value of a print counter 601 is incremented (+1) upon printing for one sheet. That is, in the yellow, magenta and cyan cartridges, the count value of the print counter 601 is incremented upon color printing. In the black cartridge, the count value of the print counter 601 is incremented upon color printing and upon monochrome printing. In a case where the photosensitive drum is not used upon actual printing but the photosensitive drum is idle-rotated since it is not moved away from the belt 250, the count value of an idle rotation counter 602 is incremented upon printing for one sheet. That is, upon monochrome printing, the count values of the idle rotation counters 602 in the memories 301 to 303 of the yellow, magenta and cyan cartridges are incremented upon printing for one sheet. The bit information indicating whether or not the lifetime of the drum of the cartridge has expired (OUT) is held in the lifetime information 603. Further, the status close to lifetime expiration (Low) can also be held. It is possible to manage plural lifetime levels by setting different bit information. The CPU 107 of the controller 103 stores these information into the memories 301 to 304 of the Y (yellow), M (magenta), C (cyan) and K (black) cartridges. That is, the CPU 107 updates the counter values (times) of one of or both the counters 601 and 602 stored in the memories of the respective cartridges upon execution of image formation on one sheet in color or monochrome printing. Note that it may be arranged such that the count values of the print counter 601 and the idle rotation counter 602 are incremented upon issuance of the paper feed signal by the CPU 107 to the printer unit 105. Further, it may be arranged such that the CPU 107 increments the count values of the print counter 601 and the idle rotation counter 602 when sheet discharge is notified with the discharged paper sensor 262 of the printer unit 105.

FIG. 6B shows an example of coefficient values for calculation of the wear and tear in actual printing and the wear and tear in idle rotation. That is, FIG. 6B shows coefficient values corresponding to cartridge use status.

A print coefficient value 606 is used when the cartridge is actually used in printing. An idle rotation coefficient value 607 is used when the cartridge is not used in printing but is idle-rotated.

In this example, the print coefficient value is "1", and the idle rotation coefficient value is "0.5". The coefficient values are simple values indicating that the wear and tear upon idle rotation is the half of the wear and tear upon actual printing. However, the wear and tear is not uniform but it may be changed in accordance with increment in the number of printed sheets, or in accordance with size of sheet used in printing, sheet type, or further, in accordance with amount of applied toner. Accordingly, it may be arranged such that a more detailed coefficient value is set in accordance with printing situation for more precise calculation of lifetime.

Figure 7:
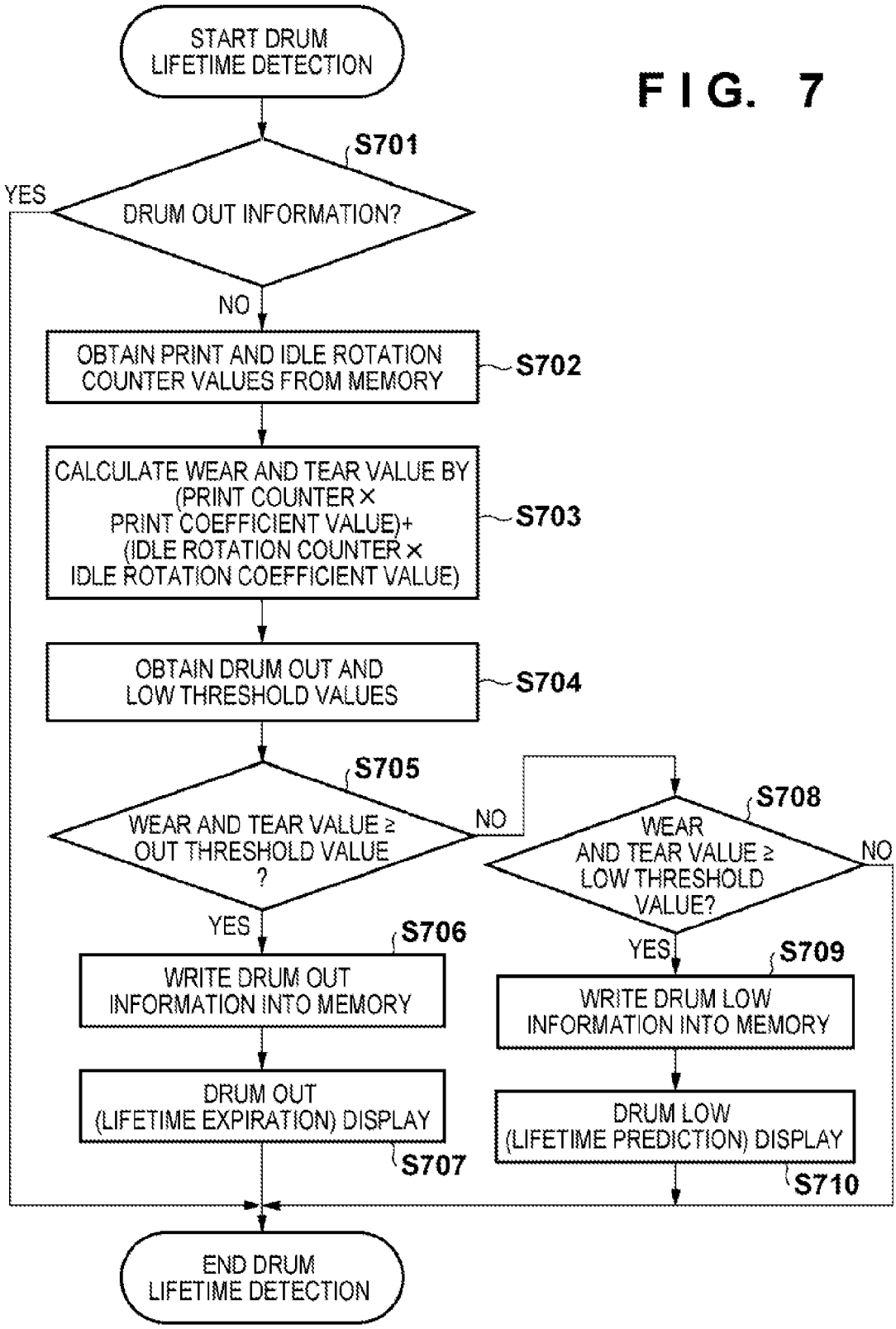
FIG. 7 is a flowchart for describing the processing of determining lifetime of the photosensitive drum by the print apparatus according to the second embodiment.

FIG. 7 is a flowchart for describing the processing of determining the lifetime of a photosensitive drum of a cartridge by the print apparatus according to the second embodiment. In the flowchart of FIG. 7, the respective steps are realized by reading and executing the program stored in the ROM 108 by the CPU 107.

When the CPU 107 prepares an image to be print-outputted on one sheet in the HDD 110 and transmits an instruction to feed one sheet to the printer unit 105, then the processing shown in the flowchart of FIG. 7 starts. The image is transmitted, together with print setting information, as a job, from the data processing apparatus 101. Note that it may be arranged such that the processing is executed by the CPU 107 at predetermined timing, e.g., upon cartridge exchange, upon start-up of the print apparatus 102, elapse of predetermined time, or upon printing for a predetermined number of pages. Note that as the processing shown in the flowchart of FIG. 7 is performed with respect to the yellow cartridge, the magenta cartridge and the cyan cartridge, the processing is repeated thrice by the CPU 107.

First, the processing performed for the yellow cartridge will be described.

In step S701, the CPU 107 determines whether or not information indicating the "drum OUT (=lifetime expired)" status is stored in the lifetime information 603 of the memory 301 of the yellow cartridge. When it is determined in step S701 that the information indicating the drum OUT status is stored, the CPU 107 determines that the lifetime of the cartridge has expired. Then the lifetime detection ends. On the other hand, when it is determined in step S701 that the information indicating the drum OUT status is not stored in the lifetime information 603, the process proceeds to step S702. In step S702, the CPU 107 obtains the respective count values of the print counter 601 and the idle rotation counter 602 from the memory 301.

Then, in step S703, the CPU 107 refers to the table in FIG. 6B, and calculates the actual drum wear and tear value using a coefficient value corresponding to the print processing. That is, the CPU 107 multiplies the count value of the print counter 601 by a print coefficient value 606 (1), multiplies the count value of the idle rotation counter 602 by an idle rotation coefficient value 607 (0.5), and adds these multiplication results up, to obtain the wear and tear value of the photosensitive drum (corresponds to the count value of the drum lifetime counter 403 in the first embodiment). Next, in step S704, the CPU 107 reads the drum Low threshold value predicting the drum lifetime and the drum OUT threshold value as a drum lifetime threshold value from the ROM 108 or the HDD 110 (acquisition of drum lifetime).

As the drum OUT threshold value, the notarization lifetime value may be used. As the drum Low threshold value, a value obtained by subtracting a predetermined value from the notarization lifetime value may be used. These values may be previously stored in the ROM 108 or the HDD 110. Next, in step S705, the CPU 107 compares the wear and tear value obtained in step S703 with the drum OUT threshold value. When (wear and tear value)≥(drum OUT threshold value) holds, as the wear and tear value of the photosensitive drum 205*a* of the yellow cartridge exceeds the OUT threshold value, the process proceeds to step S706. In step S706, the CPU 107 writes information indicating the drum OUT status into the lifetime information 603 of the memory 301 of the yellow cartridge. Then in step S707, the CPU 107 produces a drum OUT display indicating that the lifetime of the yellow cartridge has expired on the console unit 104.

On the other hand, in step S705, when (wear and tear value)<(drum OUT threshold value) holds, the CPU 107 determines that the lifetime of the photosensitive drum 205*a* of the yellow cartridge has not expired, then the process proceeds to step S708. In step S708, the CPU 107 determines whether or not the wear and tear value exceeds the Low threshold value. When it is determined in step S708 that (wear and tear value)≥(drum Low threshold value) holds, i.e., the lifetime of the photosensitive drum 205*a* of the yellow cartridge exceeds the drum Low threshold value, the process proceeds to step S709. In step S709, the CPU 107 writes a drum Low history into the lifetime information 603 of the memory 301 of the yellow cartridge. Then, in step S710, the display form is changed in correspondence with the lifetime level, and a display is produced. That is, a drum Low display indicating that the lifetime of the yellow cartridge will soon expire is displayed on the console unit 104. Note that when the wear and tear value of the photosensitive drum does not exceed the Low threshold value in step S708, the process ends.

The CPU 107 also performs the processing shown in FIG. 7 for the magenta and cyan cartridges.

Note that in the processing with respect to the black cartridge, the lifetime threshold value, obtained from (lifetime threshold value)=(notarization lifetime value), and the prediction threshold value, obtained from (prediction threshold value)=(lifetime threshold value)−(predetermined value), are used.

The CPU 107, using the configuration in the above-described first embodiment, records the number of sheets in color printing in the color counter 401 of the memory 304, and records the number of sheets in monochrome printing in the monochrome counter 402. Then the CPU 107 records the sum of the count value of the color counter 401 and the count value of the monochrome counter 402 in the drum lifetime counter 403. Thereafter, when the (wear and tear value) exceeds the (prediction threshold value), the CPU 107 displays the drum Low display (lifetime prediction display) indicating that the lifetime of the black cartridge will soon expire on the console unit 104. Then, when the (wear and tear value) exceeds the (lifetime threshold value), the CPU 107 displays the drum OUT display (lifetime expiration display) indicating that the lifetime of the black cartridge has expired on the console unit 104.

Note that the CPU 107 may continue the printing when it is determined that (wear and tear value)<(lifetime threshold value) holds. Further, the CPU 107 may stop the printing when (wear and tear value)≥(lifetime threshold value) holds. Accordingly, it is possible to assure the quality of an image to be print-outputted. Note that it may be arranged such that at timing of determination that (wear and tear value)≥(lifetime threshold value) holds, the CPU 107 performs control not to feed the next sheet, otherwise, stops the printing at the end of one current copy or the end of one current job. Further, it may be arranged such that when the CPU stops printing at the end of one print copy or the end of one job, the CPU 107 determines whether or not the remaining number of sheets of the copy or job is equal to or greater than a predetermined value. When the CPU 107 determines that the remaining number of sheets of the copy or job is equal to or greater than the predetermined value, the CPU 107 stops the printing. When the number of sheets for one copy or one job is large, this arrangement prevents printing of an image on a large number of sheets even though the lifetime of the photosensitive drum has expired.

In this manner, according to the second embodiment, even in a print apparatus where the wear and tear of consumable parts differs between color printing and monochrome printing such as a 4 series drums type of electrophotographic printer where the photosensitive drums are not moved away from the belt (transfer member), it is possible to notify cartridge exchange at appropriate timing. More particularly, it is possible to correctly determine the lifetime of the consumable part from the wear and tear of the drum upon actual printing and that upon idle rotation, and accurately notify timing of exchange of the cartridge. Further, it is possible to more accurately notify that the cartridge exchange time has come or will soon come.

Note that in the above-described second embodiment, different from the first embodiment, the print counter 601 and the idle rotation counter 602 are used. However, the color counter 401 and the monochrome counter 402 may be used as in the case of the first embodiment. In this case, a value of the color counter 401 is used in place of the count value of the print counter 601 for yellow and magenta colors, and a value of the monochrome counter 402 is used in place of the count value of the idle rotation counter 602. Further, regarding the black cartridge, the total sum of the count values of the color counter 401 and the monochrome counter 402 is used in place of the count value of the print counter 601.

<Other Embodiments>

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g. computer-readable medium).

While the present invention has been described with reference to embodiments, it is to be understood that the invention is not limited to the disclosed embodiments.

This application claims the benefit of Japanese Patent Application No. 2011-017116, filed Jan. 28, 2011, which is hereby incorporated by reference herein in its entirety.

What is claimed is:

1. A print apparatus having a photosensitive member used for color printing, comprising:

an acquisition unit configured to acquire a number of sheets on which color printing has been performed and a number of sheets on which monochrome printing has been performed; and a determination unit configured to determine whether or not a lifetime of a photosensitive member used for the color printing has expired, based on a threshold value and the sum of the number of sheets on which the color printing has been performed and the number of sheets on which the monochrome printing has been performed, the threshold value being determined based on a ratio between the number of sheets on which color printing has been performed and the number of sheets on which monochrome printing has been performed acquired by the acquisition unit, wherein the threshold value is determined by multiplying a predetermined lifetime of a toner cartridge for color printing by a coefficient corresponding to the ratio.

2. The print apparatus according to claim 1, further comprising a notification unit configured to prompt a user to exchange a toner cartridge including the photosensitive member used for the printing, when the determination unit determines that the lifetime of the photosensitive member has expired.

3. The print apparatus according to claim 2, further comprising a display unit, wherein the notification unit produces a display, to prompt the user to exchange the toner cartridge for the color printing, on the display unit.

4. The print apparatus according to claim 1, further comprising an update unit configured to update the number of sheets on which color printing has been performed, and to update the number of sheets on which monochrome printing has been performed.

5. A print apparatus having a photosensitive member used for color printing, comprising:

an acquisition unit configured to acquire a number of sheets on which color printing has been performed and a number of sheets on which monochrome printing has been performed;

a determination unit configured to determine whether or not a lifetime of a photosensitive member used for the color printing has expired, based on a threshold value and the sum of the number of sheets on which the color printing has been performed and the number of sheets on which the monochrome printing has been performed, the threshold value being determined based on a ratio between the number of sheets on which color printing has been performed and the number of sheets on which monochrome printing has been performed acquired by the acquisition unit; and a notification unit configured to prompt a user to exchange a toner cartridge including the photosensitive member used for the printing, when the determination unit determines that the lifetime of the photosensitive member has expired, wherein the threshold value is divided into a plurality of levels, and wherein the determination unit calculates the threshold value for the plurality of levels, and determines the lifetime of the toner cartridge as one of a plurality of stages in correspondence with the plurality of levels, and the notification unit changes notification in correspondence with each of the stages as the stages are reached.

6. A control method for a print apparatus having a photosensitive member used for color printing, comprising:

an acquisition step of acquiring a number of sheets on which color printing has been performed and a number of sheets on which monochrome printing has been performed; and a determination step of determining whether or not a lifetime of a photosensitive member used for the color printing has expired, based on a threshold value and the sum of the number of sheets on which the color printing has been performed and the number of sheets on which the monochrome printing has been performed, the threshold value being determined based on a ratio between the number of sheets on which color printing has been performed and the number of sheets on which monochrome printing has been performed, acquired in said acquisition step, wherein the threshold value is determined by multiplying a predetermined lifetime of a toner cartridge for color printing by a coefficient corresponding to the ratio.

7. A non-transitory computer readable storage medium storing a program for causing a computer to implement the method of controlling a print apparatus having a photosensitive member used for color printing, the method comprising:

an acquisition step of acquiring a number of sheets on which color printing has been performed and a number of sheets on which monochrome printing has been performed; and a determination step of determining whether or not a lifetime of a photosensitive member used for the color printing has expired, based on a threshold value and the sum of the number of sheets on which the color printing has been performed and the number of sheets on which the monochrome printing has been performed, the threshold value being determined based on a ratio between the number of sheets on which color printing has been performed and the number of sheets on which monochrome printing has been performed, acquired in said acquisition step, wherein the threshold value is determined by multiplying a predetermined lifetime of a toner cartridge for color printing by a coefficient corresponding to the ratio.

8. A cartridge having a photosensitive member available in a print apparatus for performing color printing, said print apparatus comprising:

an acquisition unit configured to acquire a number of sheets on which color printing has been performed and a number of sheets on which monochrome printing has been performed; and a control unit configured to determine a lifetime of the photosensitive member based on a threshold value determined based on the ratio between the respective number of sheets acquired by the acquisition unit, and the sum of the number of sheets on which the color printing has been performed and the number of sheets on which the monochrome printing has been performed acquired by the acquisition unit wherein the threshold value is determined by multiplying a predetermined lifetime of a toner cartridge for color printing by a coefficient corresponding to the ratio.

9. A print apparatus, comprising:

a counter configured to, upon color printing on one sheet, increment a count value of a number of sheets used in printing using at least one photosensitive member for the color printing by one, and upon monochrome printing on one sheet, increment a count value of a number of sheets used in printing using a photosensitive member for the monochrome printing by 0.x (x is an integer); and a determination unit configured to determine whether or not a lifetime of the at least one photosensitive member for the color printing has ex sired based on the number of sheets counted by the counter and a predetermined threshold value.

* * * * *